US005529373A

United States Patent [19]

Olson et al.

[11] Patent Number: 5,529,373

[45] Date of Patent: Jun. 25, 1996

[54] APPARATUS AND METHOD FOR COVERING A CHAIR FORM WITH FABRIC

[75] Inventors: Ogden R. Olson; John Hocke, both of Muscatine, Iowa

[73] Assignee: Hon Industries Inc., Muscatine, Iowa

[21] Appl. No.: 266,139

[22] Filed: Jun. 27, 1994

[51] Int. Cl.[6] ..... A47C 31/11

[52] U.S. Cl. ..... 297/218.4; 297/228.11

[58] Field of Search ..... 297/218.1, 218.4, 297/228.11, 219.1; 5/402, 496

[56] References Cited

U.S. PATENT DOCUMENTS

| | | | |
|---|---|---|---|
| 2,191,848 | 2/1940 | Cramer et al. | 297/228.11 |
| 2,483,223 | 9/1949 | Moss | 297/228.11 |
| 3,147,797 | 3/1965 | Neufeld | 297/228.4 X |
| 4,732,097 | 3/1988 | Guilhem . | |
| 5,338,092 | 8/1994 | Wiltsey et al. | 297/218.4 X |

FOREIGN PATENT DOCUMENTS

| | | | |
|---|---|---|---|
| 709668 | 6/1954 | United Kingdom | 297/218.4 |

*Primary Examiner*—Peter R. Brown
*Attorney, Agent, or Firm*—Jones, Day, Reavis & Pogue

[57] ABSTRACT

Fabric covered furniture comprises a form member having a straight edge portion contouring into a relatively curved edge portion with fabric covering the front surface and edges thereof. A drawstring is secured along the border of the fabric. A flange element is positioned on the rear surface of the form member adjacent the straight edge portion, the flange having a curvilinear surface projecting generally inwardly of the rear surface. The drawstring is secured over the curvilinear surface of the flange thereby pulling the fabric tightly in the area of the relatively straight edge portion of the form.

7 Claims, 3 Drawing Sheets

APPARATUS AND METHOD FOR COVERING A CHAIR FORM WITH FABRIC

BACKGROUND OF THE INVENTION

1. Field of the Invention

The present invention relates generally to an apparatus and method for covering a chair form with fabric and it relates, more particularly, to an apparatus and method for securing fabric to a chair form in a manner which stretches the fabric uniformly over the form in order to control the shape of the upholstery and to prevent limpness of portions of the fabric at edges of the form.

2. Description of the Prior Art

In the manufacture of fabric covered chairs and other furniture, a process is known for securing a fabric piece to a form, such as a seat or back member, by sewing an overcast stitch at the border of the fabric piece and trapping a drawstring within a passageway formed thereby. The fabric then can be placed over the front of the form, stretched over the edges of the form and drawn tight by the draw string at the back of the form such that the fabric completely covers the form edges. Such a process is disclosed in U.S. Pat. No. 4,732,097 issued to Guilhem on Mar. 22, 1988, which is incorporated herein by reference.

When using a fabric having a draw string along its border to cover a form, the string applies greater force to the fabric at sharp curves or corners of the form tending to pull the fabric more tautly at the curves or corners. Most chair forms, such as seats and backs, are non-circular in shape and are often generally rectangular with sharply bent or curved corners. Thus, when drawn over the edges of the form, the fabric is applied relatively tightly at the corners and is relatively limp along the straight or less curved edges of the form. The result is a covered form wherein the fabric puckers or puffs out along the straight or less curved edges of the form, creating an unacceptable finished product.

In order to provide adequate control of upholstery shape and to solve the problem of limpness along the straight or less curved edges of the form, it has been previously necessary to manually pull the upholstery fabric inwardly of the form at the puckered or puffed sections until the fabric becomes tight and then to staple or otherwise affix the fabric to the back of the form. In an alternative approach which has been previously employed, the form is provided with a series of hooks which are fastened to the back of the form and are positioned so that the draw string can be pulled inwardly of the form into engagement with the hooks. However, it is to be noted that both of these methods require additional labor in the assembly of a fabric covered forth. Also, it has been found that the use of staples or hooks placed intermittently along the back of the form causes the fabric to assume a scalloped configuration at the adjacent edge intermediate the fastening points. This, results in an upholstered product having a covering exhibiting an unacceptable appearance.

It would, therefore, be desirable to provide an apparatus and method for enabling control of the upholstery shape and for pulling the fabric of a covered form over the edges of the form in a uniformly tight manner whether the form has a circular or non-circular shape.

SUMMARY OF THE INVENTION

The present invention improves over the prior art by providing a flange on the back of a fabric covered form adjacent a relatively straight edge of the form at which the fabric tends to be limp under normal circumstances. The flange is configured to curve inwardly toward the center of the form so that when the draw string of the fabric is engaged by the flange, the fabric is tightly pulled inwardly of the form back to control the shape of the upholstery and to eliminate limpness of the fabric. Because the flange has a generally uniform inward curvature, the scalloped appearance of the fabric which normally results when intermittent staples or hooks are employed to pull the fabric tight is avoided.

BRIEF DESCRIPTION OF THE DRAWINGS

The features and advantages of the invention will become apparent from the following detailed description taken in connection with the accompanying drawings wherein.

DETAILED DESCRIPTION OF THE PREFERRED EMBODIMENTS

Figure 1:
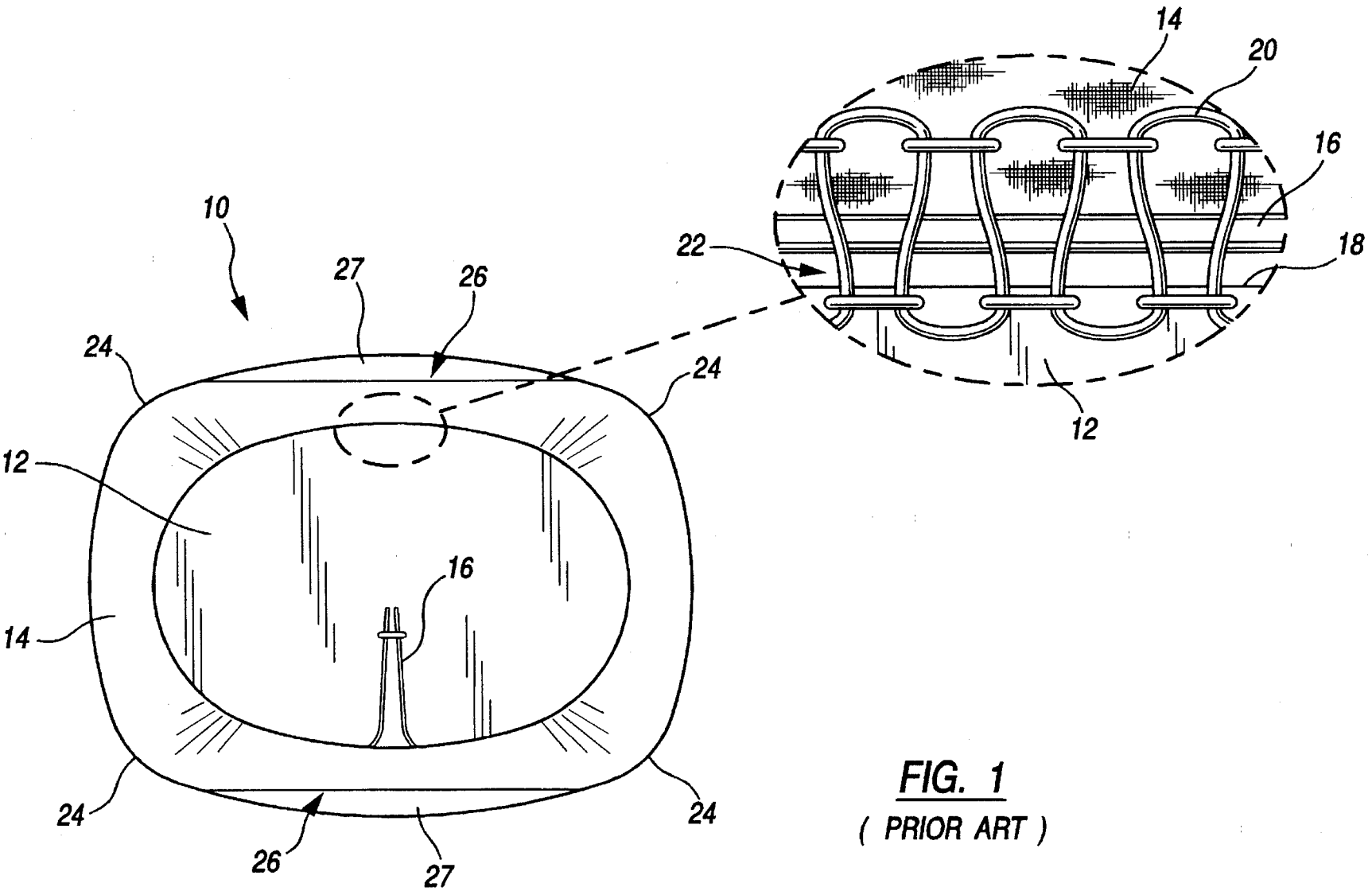
FIG. 1 ( PRIOR ART )
FIG. 1 is a view of a fabric covered chair back illustrating the prior art method of using a draw string to secure the fabric to a form, the draw string being shown in enlarged fractional plan view.

Turning now to the drawings, and initially to FIG. 1, a prior art seat back designated generally by the reference numeral 10 is shown in rear plan view and includes a form 12 covered with an elastic fabric 14. The form 12 may be fabricated in a variety of ways including blow molding or injection molding plastic. Alternatively, the form 12 may be a wood mold or shaped plywood or it may be formed from any other suitable structural material including metals, ceramics and the like. In a manner now well-known in the art as exemplified in U.S. Pat. No. 4,732,097, the fabric covering 14 is constructed with a draw string 16 at its border 18 by the method of sewing an overstitch 20 at the border 18. The overstitch 20 essentially forms a passageway 22 through which the draw string 16 extends and is free to move longitudinally.

As illustrated in FIG. 1, the seat back 10 is of conventional shape and has relatively sharp corners 24 joining relatively straight edges 26 of the form 12. As hereinabove discussed, the fabric 14 at the corners 24 is stretched toward the center of the form 12 to a greater degree than the fabric along the relatively straight edges 26 of the form 12. This causes the fabric 14 to be relatively limp in the area of the straight edges 26 which results in the formation of unacceptable discontinuities 27 such as puckers or puffing of the fabric 14.

Figure 3:
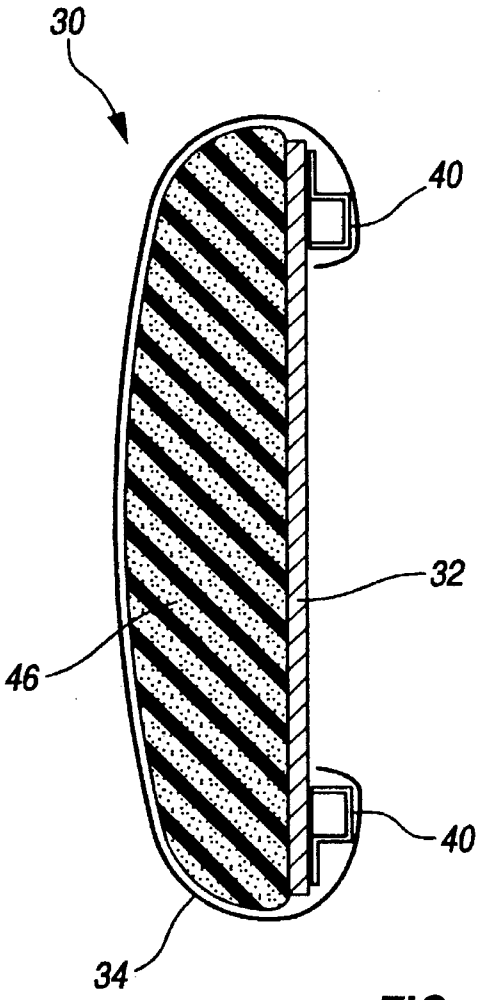
FIG. 3 is a side cross-sectional view of the chair back illustrated in FIG. 2.
Figure 2:
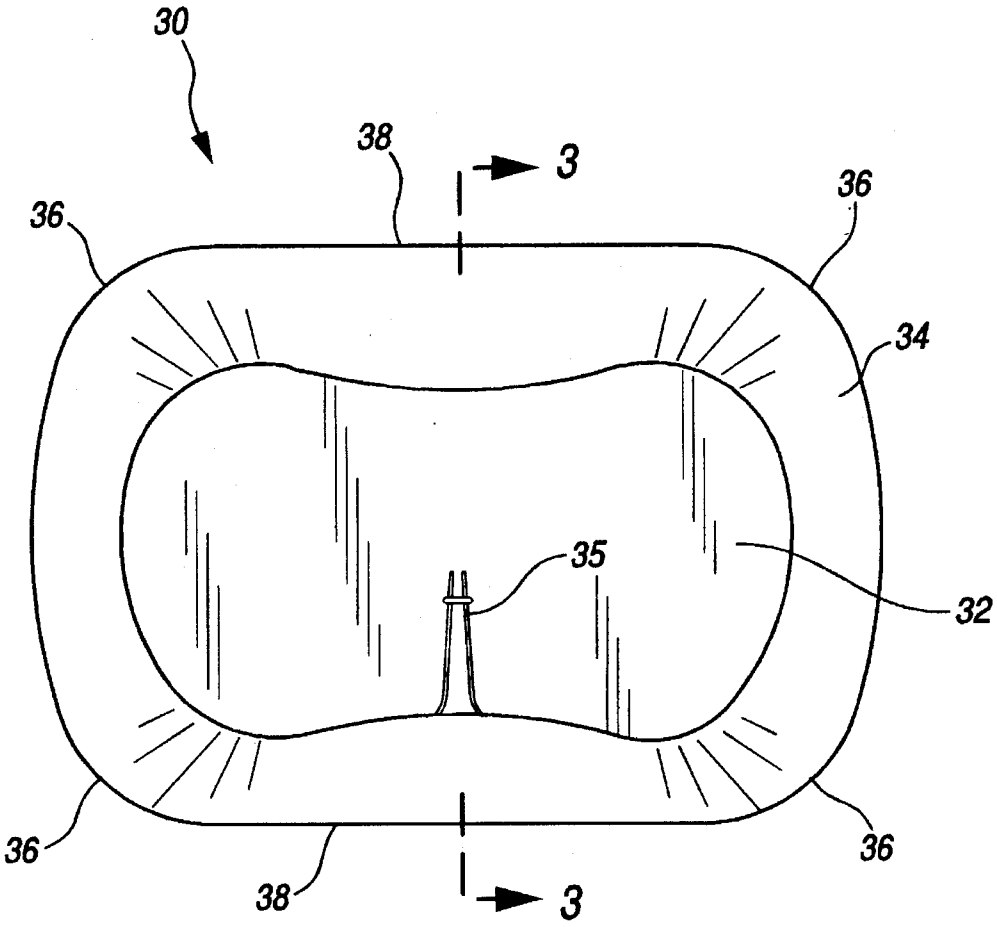
FIG. 2 is a rear view of a fabric covered chair back in accordance with the present invention.

Turning now to FIGS. 2 and 3, there is shown a seat back, designated generally by the reference numeral 30, constructed in accordance with the present invention. The seat back 30 comprises a form 32 over which a fabric 34 is stretched using a draw string 35 method as previously described. The form 32, as illustrated, is identical to the form 12 of FIG. 1 with relatively sharp corners 36 joining relatively straight edges 38. However, in accordance with the invention as best illustrated in FIG. 3, the back of the form 32 is provided with flanges 40 fixed to the form 32 adjacent the straight edges 38. The fabric 34 is the form 32 to stretch the fabric 34 tightly. The stretching of the fabric 34 enables control of the upholstery shape and prevents fabric puckering or puffing in the area of the relatively straight edges 38.

Figure 4:
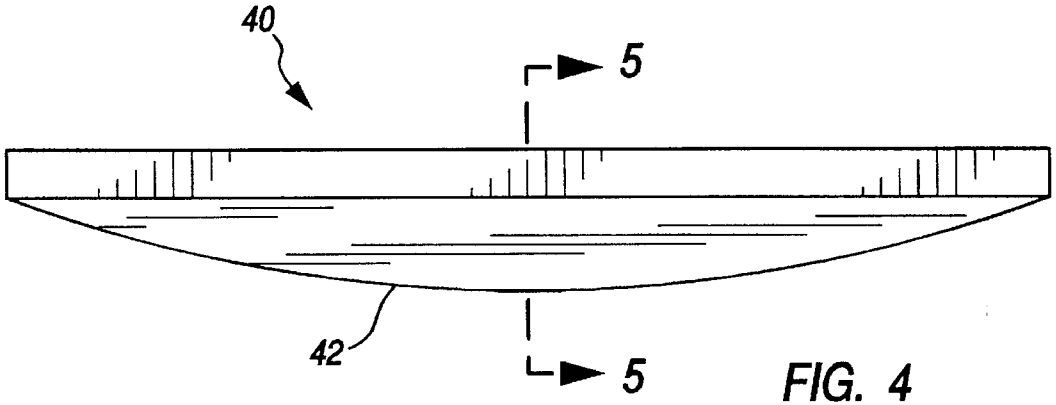
FIG. 4 is a plan view of a flange constructed in accordance with the invention.
Figure 5:
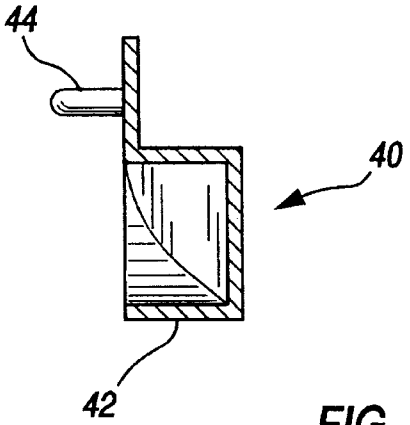
FIG. 5 is a cross-sectional view of the flange taken substantiality along the lines 5—5 of FIG. 4.

Illustrated in FIGS. 4 and 5 is one embodiment of the flange 40. In this embodiment, the flange 40 is injection molded from a suitable plastic and formed to have a continuous curvilinear surface 42 over which the draw string 35 is stretched. The flange 40 may be secured to the seat form 32 by a variety of methods, including tacking, stapling, and gluing. Pins 44 may be provided to positively fix the flange 40 to the chair form 32. The flange 40 is preferably dimensioned such that it extends substantially the entire length of the straight edge 38 portion of the seat back 30.

As best seen in FIG. 3, the illustrated flange 40 is readily attachable to a form 32 made of plywood and covered with foam 46. However, it should be noted that in a preferred embodiment of this invention, the seat back 30 is fabricated as an injection or blow molded form 32 having flanges 40 formed as an integral part thereof. Likewise, with a wood mold form, the flanges can be integrally formed, if desired.

Figure 6:
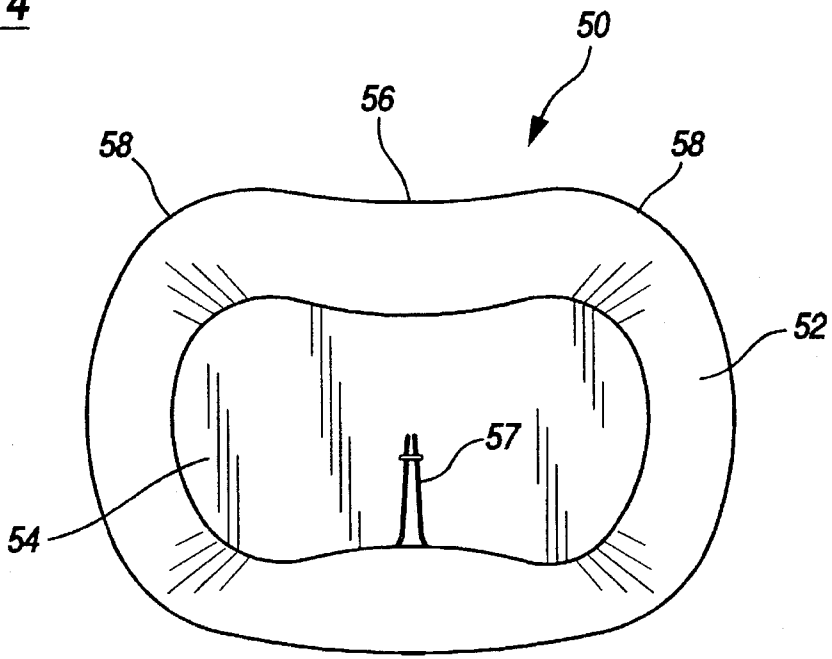
FIG. 6 is a rear view of a fabric covered chair back in accordance with a second embodiment of the invention.

FIG. 6 illustrates another embodiment of the present invention which provides a seat back 50 with a fabric covering 52 wherein a seat form 54 has an outwardly concave edge 56. The fabric 52 is fitted with a suitable drawstring 56 in the conventional manner detailed above and the form 54 is provided with a flange in the area of the edge 56 acting to pull the fabric 52 inwardly of the form 54. This embodiment illustrates that the flange 40 of the instant invention is capable of providing a tight fabric edge even when the edge 56 of the form 54 is inwardly curvilinear or outwardly concave. Without the provision of the flange 40 adjacent edge 56, the fabric 52 would extend essentially straight across between corners 58 and 58' of the form 54 and it would not be possible to control the upholstery shape and achieve an inwardly directed edge 56 having a tight fabric fit as is accomplished in accordance with the present invention.

While the present invention has been described in connection with particular embodiments thereof, it will be understood by those skilled in the art that many changes may be made without departing from the true spirit and scope of the present invention.

What is claimed is:

1. Fabric covered furniture comprising:

a form member comprising a structural component of said furniture, said form member having a front and a rear surface and configured with at least one relatively straight edge portion contouring into a relatively sharply curved edge portion;

fabric for covering said front surface of said form member;

a draw string secured along a border of said fabric; and a flange element positioned on said rear surface of said form member adjacent said relatively straight edge portion, said flange element having an outwardly convex surface projecting generally inwardly toward the center of said rear surface from said relatively straight edge portion of said form member in a manner such that said draw string and fabric border can be secured tightly over said convex surface of said flange element when said fabric is stretched over said form member whereby said fabric is pulled tightly in the area of said relatively straight edge portion of said form.

2. The furniture of claim 1 wherein said form member is non-circular in plan view.

3. The furniture of claim 1 wherein said flange element extends substantially the same length as the length of said relatively straight edge portion.

4. The furniture of claim 3 wherein said curvilinear surface of said flange is substantially continuous from one end to another.

5. The furniture of claim 1 wherein said flange is a separate member secured to said form member by fasteners.

6. The furniture of claim 1 wherein said form member is an integrally molded member and said flange is integrally formed on the back thereof.

7. A method for fabricating a furniture component comprising the steps of:

providing a form member having a front and rear surface, said form member configured with at least one relatively straight edge portion contouring into a relatively sharply curved edge portion, said form member further having a flange thereon extending along the relatively straight edge portion of the rear surface of said form member, said flange having an outwardly convex surface projecting generally inwardly toward the center of said rear surface;

stretching a fabric having a draw string around its border over the front surface of said form member and over the entire peripheral edge thereof; and drawing said draw string tight over the convex surface of said flange causing said fabric to tighten adjacent said relatively straight edge portion of said form member.

* * * * *